US006190022B1

(12) United States Patent
Tocci et al.

(10) Patent No.: US 6,190,022 B1
(45) Date of Patent: Feb. 20, 2001

(54) ENHANCED NON-LETHAL VISUAL SECURITY DEVICE

(75) Inventors: Nora C. Tocci, Sandia Park; Eric J. Cramer, Albuquerque; Michael D. Tocci, Sandia Park; John D. German, Cedar Crest, all of NM (US)

(73) Assignee: Science & Engineering Associates, Inc., Albuquerque, NM (US)

( * ) Notice: Under 35 U.S.C. 154(b), the term of this patent shall be extended for 0 days.

(21) Appl. No.: 09/409,328

(22) Filed: Sep. 30, 1999

Related U.S. Application Data

(63) Continuation-in-part of application No. 08/967,426, filed on Nov. 10, 1997, now Pat. No. 6,007,218, which is a continuation-in-part of application No. 08/518,230, filed on Aug. 23, 1995, now Pat. No. 5,685,636.

(60) Provisional application No. 60/135,231, filed on May 21, 1999.

(51) Int. Cl.[7] ..... F21K 7/00; F21V 8/00

(52) U.S. Cl. ..... 362/259; 362/231; 362/184; 362/553; 362/555; 89/1.11

(58) Field of Search ..... 362/230, 231, 362/234, 251, 259, 184, 553, 555; 42/103; 89/1.11; 434/21

(56) References Cited

U.S. PATENT DOCUMENTS

| | | | | |
|---|---|---|---|---|
| 4,048,631 | * | 9/1977 | Flores | 362/184 |
| 4,963,798 | * | 10/1990 | McDermott | 362/231 |
| 5,072,342 | | 12/1991 | Minovitch | 362/111 |
| 5,243,894 | | 9/1993 | Minovitch | 89/1.11 |
| 5,375,043 | * | 12/1994 | Tokunaga | 362/231 |
| 5,417,573 | * | 5/1995 | Cassiere, II et al. | 434/21 |
| 5,527,308 | | 6/1996 | Anderson et al. | 606/14 |
| 5,584,137 | * | 12/1996 | Teetzel | 42/103 |
| 5,685,636 | | 11/1997 | German | 362/259 |
| 5,713,654 | * | 2/1998 | Scifres | 362/259 |
| 5,734,504 | | 3/1998 | Billman | 359/618 |
| 5,761,235 | | 6/1998 | Houde-Walter | 372/77 |
| 5,808,226 | | 9/1998 | Allen et al. | 89/1.11 |
| 5,814,041 | | 9/1998 | Anderson et al. | 606/15 |
| 6,007,218 | | 12/1999 | German et al. | 362/259 |
| 6,007,219 | * | 12/1999 | O'Meara | 362/259 |

* cited by examiner

*Primary Examiner*—Alan Cariaso
(74) *Attorney, Agent, or Firm*—Perkins, Smith & Cohen, LLP; Jacob N. Erlich; Jerry Cohen

(57) ABSTRACT

A self-contained non-lethal security device for providing an optimally effective and eye-safe beam for use as a high-brightness visual countermeasure. The security device has one or more wavelengths of laser or light-emitting diode (LED) light in a continuous or flicker mode in order to provide a glare or flashblinding visual effect. A flicker mode of two wavelengths at opposite ends of the visible spectrum (e.g., red and green) produces heightened disorientation to the adversary. Replacing one or all of the laser light source with LEDs for shorter range applications reduces the overall cost of such a security device.

33 Claims, 9 Drawing Sheets

ENHANCED NON-LETHAL VISUAL SECURITY DEVICE

CROSS REFERENCE TO RELATED APPLICATIONS

This invention is a continuation-in-part of U.S. patent application Ser. No. 08/967,426 filed Nov. 10, 1997 now U.S. Pat. No. 6,007,218 issued Dec. 28, 1999 entitled SELF-CONTAINED LASER ILLUMINATIOR MODULE which is a continuation-in-part of U.S. patent application Ser. No. 08/518,230 filed Aug. 23, 1995 entitled EYE SAFE LASER SECURITY DEVICE now U.S. Pat. No. 5,685,636 issued Nov. 11, 1997. The present application also claims priority of U.S. Provisional Application Ser. No. 60/135,231 filed May 21, 1999. A PCT application Ser. No. PCT/US98/01662 was filed on Jan. 29, 1998 based upon U.S. patent application Ser. No. 08/967,426. Another PCT Application Ser. No. PCT/US96/13556 is based upon U.S. patent application Ser. No. 08/518,230.

BACKGROUND OF THE INVENTION

This invention relates generally to non-lethal, non-eye-damaging security devices based on intense light and, more particularly to non-lethal, non-damaging security devices to provide low-cost, extremely effective warning, visual impairment, and disorientation through illumination by bright, visible light beams.

In recent years, the employment of non-lethal weapons has proven effective in dealing with adversaries in a variety of law enforcement, corrections, and physical security scenarios. In these areas, the goal of security personnel in most confrontations is to employ the lowest level of force necessary to control the situation. The possible levels of response fall on a force continuum ranging from a simple verbal warning through various degrees of physical interaction to the use of lethal weapons such as firearms. Within the levels of physical interaction, as the severity of response increases, the possibility of permanent injury or unintentional death also increases as does the possibility of legal or political repercussions. Also, as the level of force applied increases, adversaries will often escalate their response thereby increasing the risk of injury to the security personnel. Any means to minimize the level of interaction is therefore of great value to security personnel and their adversaries alike.

Ultra-bright light sources such as lasers offer an effective means to control escalation of confrontations between security personnel and adversaries. These light sources provide five levels of physical interaction with adversaries at the "soft" end of the force continuum: (1) language-independent, unequivocal warning; (2) psychological impact such as distraction and fear; (3) temporarily impaired vision; (4) physiological response to the light such as disorientation and nausea; and (5) reduced ability to perform hostile acts such as throwing objects, attacking, or aiming firearms. In addition, the adversaries response to the illumination can provide security personnel with threat assessment in terms of intent and resolve. Examples of such devices are described in U.S. Pat. No. 5,685,636 and U.S. patent application Ser. No. 08/967,426, now U.S. Pat. No. 6,007,218 both of which are incorporated herein by reference.

Within the various application areas, there are many scenarios where a non-lethal response with ultra-bright lights can be beneficial. These include perimeter protection for government and industrial facilities, apprehension of unarmed but violent subjects, protection from suspected snipers, protection from assailants, and crowd/mob control. Prison guards need non-lethal options in a variety of situations including cell extractions, breaking up fights, an controlling disturbances. Another important class of scenarios are those which limit the use of potentially lethal weapons because innocent people are present. These include hostage situations, protection of political figures in crowds, airport security, and crowd control.

A similar situation occurs when use of firearms or explosives in the battlefield may cause unacceptable collateral damage to equipment or facilities, such as aircraft or electronic equipment. In time-critical scenarios, such as raids on hostile facilities or criminal hideouts, where even a few seconds of distraction and visual impairment can be vital to the success of the mission, visual countermeasures can enhance the capabilities of law enforcement personnel.

Bright light sources are capable of a range of effects on human vision which depend primarily on the wavelength (measured in nanometers), beam intensity at the eye (measured in watts/square centimeter), and whether the light source is pulsed or continuous-wave. There are three types of non-damaging effects on vision: (1) glare, (2) flashblinding, and (3) physiological disorientation.

The glare effect is a reduced visibility condition due to a bright source of light in a person's field of view. It is a temporary effect that disappears as soon as the light source is extinguished, turned off, or directed away from the subject. The light source used must emit light in the visible portion of the wavelength spectrum and must be continuous or flashing to maintain the reduced-visibility glare effect. The degree of visual impairment due to glare depends on the brightness of the light source relative to ambient lighting conditions.

The flashblinding effect is a reduced visibility condition that continues after a bright source of light is switched off. It appears as a spot or afterimage in one's vision that interferes with the ability to see in any direction. The nature of this impairment makes it difficult for a person to discern objects, especially small, low-contrast objects or objects at a distance. The duration of the visual impairment can range from a few seconds to several minutes. The visual impairment depends upon the brightness of the initial light exposure and the ambient lighting conditions and the person's visual objectives. The major difference between the flashblind effect and the glare effect is that visual impairment caused by flashblind remains for a short time after the light source is extinguished, whereas visual impairment due to the glare effect does not. Some degree of flashblinding can also remain after a glare exposure, especially with laser.

Physiological disorientation occurs in response to a flashing light source. It is caused by the attempt of the eye to respond to rapid changes in light level or color. For on-and-off flashing, the pupil of the eye is continually constricting and relaxing in response to the contrasting light intensity reaching the eye. In addition, differing colors as well as differing light intensities cause the same effect.

Past concepts for the eye-safe laser security device, such as described in U.S. Pat. No. 5,685,636 and U.S. patent application Ser. No. 08/967,426 now U.S. Pat. No. 6,007,218 employ a single laser as the light source. The laser can operate at any narrow wavelength band between 400 and 700 nanometers (the entire visible light spectrum from blue to red) and provide either continuous or repetitively pulsed (on-off flashing) light. Although effective, these type of past non-lethal security devices could benefit from improvements in the areas of safety in use, overall effective, susceptibility to countermeasures, and cost.

It is therefore an object of this invention to provide a non-lethal, visual security device that is capable of low cost manufacture.

It is another object of this invention to provide a non-lethal, visual security device that is extremely effective as a visual countermeasure under a wide range of conditions.

It is still another object of this invention to provide a non-lethal, visual security device that is relatively unsusceptible to countermeasures.

SUMMARY OF THE INVENTION

The objects set forth above as well as further and other objects and advantages of the present invention are achieved by the embodiments of the invention described hereinbelow.

The present invention provides enhancements to the original concepts incorporated in non-lethal security devices based upon the visual impairment of an adversary for their effectiveness. These enhancements within the non-lethal visual security device of this invention are provided by, but not limited to, the inclusion therein of components capable of smoothing the output beam intensity pattern and producing multiple color output beams as well as the incorporation therein of low cost light-emitting diodes (LEDs).

More specifically, the present invention provides an effective system for converting the structured intensity pattern of the light source to a relatively smooth, uniform beam having a relatively flat beam intensity distribution throughout the beam area, thus ensuring the non-lethal security device of the present invention does not produce an output beam which exceeds a Maximum Permissible Exposure (MPE) level as defined by the National Standards Institute. By the addition of multiple color light sources within the present invention, disorientation of an adversary can be greatly increased and make the use of countermeasures impractical. Further, the incorporation within the present invention of circuitry which permits the use of low cost light-emitting diodes substantially reduces the cost of the device.

For a better understanding of the present invention, together with other and further objects thereof, reference is made to the accompanying drawings and detailed description and its scope will be pointed out in the appended claims.

DETAILED DESCRIPTION OF THE PREFERRED EMBODIMENTS

Figure 1B:
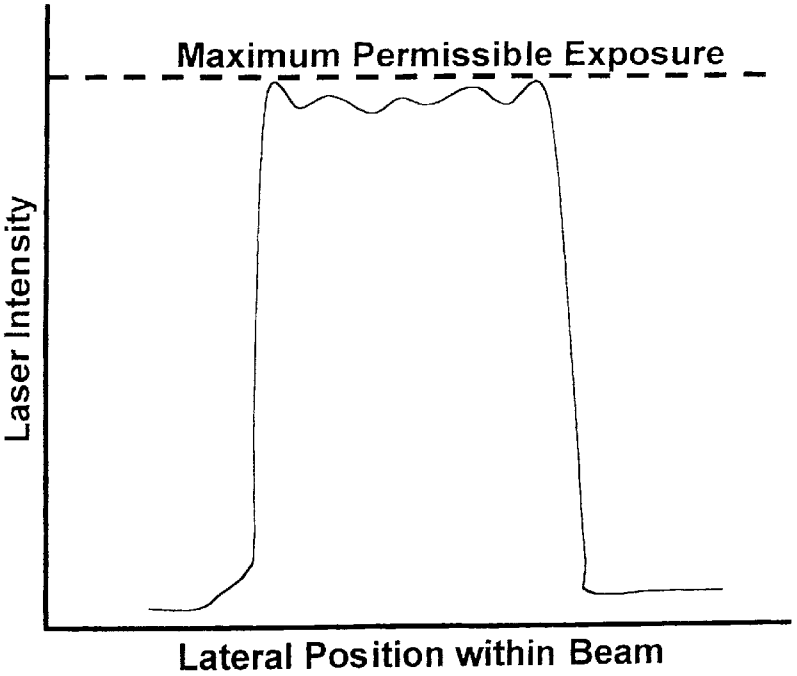
FIG. 1*b* is a graphic representation of a laser output beam having an intensity peak substantially flat across its entire diameter.

Visual security devices such as the type described in U.S. Pat. No. 5,685,636 and U.S. patent application Ser. No. 08/967,426, now U.S. Pat. No. 6,007,218, both of which being incorporated herein by reference, utilize extremely bright light at predetermined wavelengths, beam diameters, intensities, and flashing patterns to create temporary visual impairment (by glare and/or flashblinding) to cause hesitation, delay, distraction, disorientation, and reductions in functional effectiveness of human adversaries. The present invention overcomes drawbacks associated therewith.

In order to better understand the present invention, the following description initially provides a basic overview of the concepts involved with the present invention followed by a detailed description of the various preferred embodiments of this invention for effecting those concepts in enhanced non-lethal visual security devices.

The lasers used in the security devices of the type described in U.S. Pat. No. 5,685,636 and U.S. patent application Ser. No. 08/518,230 can be costly relative to the value of the device in certain security communities. Although costs of both Nd:YAG green lasers (Casix Corp., DPGL-1050, for example) and semiconductor diode red lasers (SDL Model 7422-H1 or Applied Optronics Corp., AOC-670-250-T3 for example) suitable for this application have steadily decreased over the past few years, they are still quite expensive. This laser cost drives the price of such laser security devices out of reach for many law enforcement customers.

One preferred embodiment of the present invention utilizes one or more light-emitting diodes (LEDs) in place of the laser for certain, short-range applications. Light-emitting diodes are non-laser semiconductor light sources that share a laser's ability to emit light of a specific. Recently several ultra-brightness Single LEDs (Gilway Technical Lamp Stock # E184—red, E903—green, E474—blue for example) and LED arrays (Opto Technology Stock # OTL-660A-9-4-66-E—red, OTL530A-3-4-66-E—green, OTL-470A-3-4-66-E—blue for example) are commercially available. The cost of such single LEDs and LED arrays are considerably less than that of a laser. By the utilization of LEDs and/or LED arrays and their associated circuitry within the non-lethal security device of the present invention, the present invention takes advantage of such cost savings.

When the intensity of visible light at the eye exceeds a certain level, injury to the retina can occur in the form of lesions (i.e. small burns) at the focal spot of the light. To ensure that visual security devices are non-damaging to the human eye, the intensity present at the subject's eye must be below the Maximum Permissible Exposure (MPE) as defined in ANSI Z136.1 published by the American National Standards Institute. For continuous or flashing light sources utilized within such security devices, the exposure level is measured in watts per square centimeter. If the laser intensity anywhere within the beam diameter exceeds the MPE, the possibility of retinal injury exists.

Figure 1A:
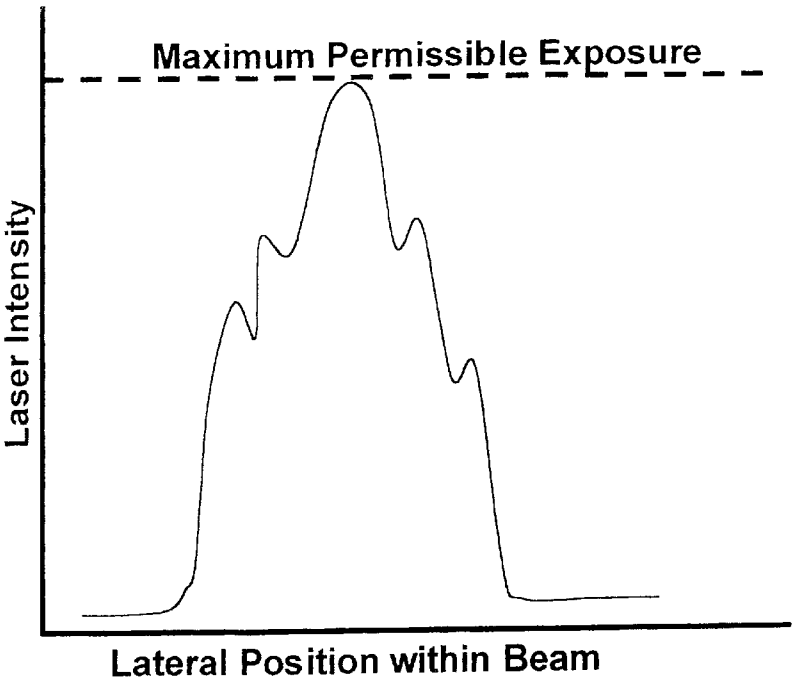
FIG. 1*a* is a graphic representation of a laser output beam having a strong central intensity peak.

The output beams produced by most lasers are not of uniform intensity throughout the beam area but rather have one or more "hot" spots. Within these hot spots, the light intensity can be several times brighter than the average intensity of the beam. For a laser beam to be eye safe, no point in the beam can exceed the MPE so if the beam has hot spots, the laser output power must be reduced to keep these areas below the MPE. Lowering the output power, however, can greatly reduce the effectiveness of the laser device as a security device because the beam will not provide as much glare and flashblinding. The ideal laser beam for these applications would have a flat intensity profile throughout the entire beam area. FIGS. 1*a* and 1*b* of the drawings illustrate this point. The typical laser output beam of FIG. 1*a* has a strong central intensity peak that must be kept below the MPE level. However, the laser beam of FIG. 1*b* is essentially flat across its entire diameter, allowing the laser output power and the brightness of the beam as seen by an adversary to be several times greater than the beam in FIG. 1*a*.

In some cases, within the present invention, it is beneficial to alter the output pattern of a light source or light emitter in order to achieve illumination that is more uniform than otherwise possible from the light emitter. For example, typical semiconductor laser diodes emit light that is highly divergent in one direction and much less divergent in the perpendicular direction. The result is an illumination pattern that is rectangular, often 20 times wider in one direction (up and down, for example) than in the perpendicular direction (left and right, for example). In this case, in order to achieve more uniform illumination, it is beneficial to alter the output pattern by focusing the semiconductor laser diode's light into an optical fiber. Light emitted from the distal end of the fiber is then made more uniform by the physical properties of the optical fiber. The rectangular emission pattern of light emission from the semiconductor laser diode is altered, by focusing the light into an optical fiber and into a round and uniform illumination pattern. A more detailed description of the optical fibers and there relationship with the light sources are provided below with respect to FIGS. 2 through 4.

In the embodiment of the present invention related to the use of LEDs as a light source or light emitter, the light emitter output pattern is already relatively uniform. It should be realized that focusing the emitter's light into an optical fiber will still improve the uniformity of the illumination pattern. However, with such a relatively uniform emitter, it may be possible to achieve sufficiently uniform illumination without the use of an optical fiber.

Another element of cost in an eye-safe laser security device derives from the need to ensure that the light intensity never exceeds the MPE. Special electronic circuitry is required to sense the light output level from the laser and adjust it downward if it begins to increase due to temperature or aging effects inherent in the laser design. Because light from non-laser sources such as LEDs of the type utilized with the present invention is not coherent, it cannot be focussed to as small a spot on the retina as is possible with laser light. Consequently, the possibility of injury for non-laser sources is greatly reduced and, therefore, no U.S. standard for safe LED exposure levels has been established. Because there is no need to control the LED output level for safety purposes, further cost reduction is possible by elimination of the output control circuitry.

A further preferred embodiment of the present invention utilizes at least two colors of light within the security device to substantially improve the effectiveness of the device when used to produce physiological disorientation in the flashing mode. By the incorporation within the device of electronic circuitry as described in detail with respect to FIGS. 7 and 8 of the drawings, to sequentially flash first one color light source then another color light source in repeated cycles, enables the disorientation of an adversary to be significantly greater than that produced by a single-color on-off flashing light.

In addition, by limiting the output to a single wavelength, as in past devices, the laser security device becomes vulnerable to a relatively inexpensive countermeasure: the use of laser protective eyewear designed to filter out the specific laser wavelength in use. Laser goggles for this purpose can be purchased from Edmund Scientific (catalog item # F38237 for green lasers and item # F38216 for red lasers). Such a countermeasure is only possible, however, if the adversary knows the laser wavelength in advance. Although special purpose goggles could be developed to protect two or more different color light sources, they will block out most of the visible light, making it difficult for the adversary to see anything. A laser security device capable of emitting two or more colors of light; either selectably, simultaneously, or sequentially in a flashing mode; will make the use of this countermeasure impractical.

Figure 2:
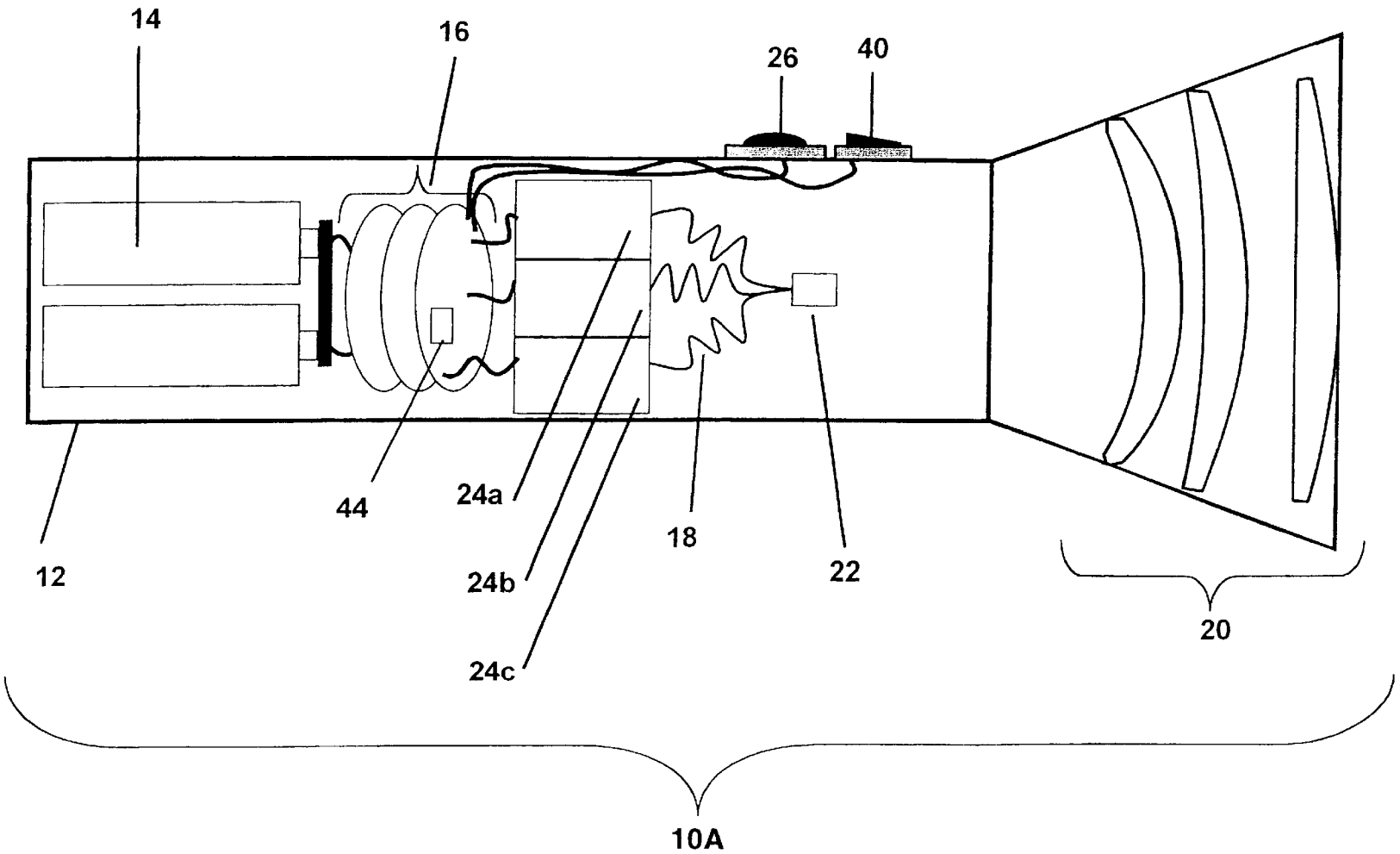
FIG. 2 is a schematic representation of a preferred embodiment of the present invention using multiple laser light sources.

Reference is now made to FIGS. 2–8 of the drawings for a more detailed description of the inventive embodiments where, for ease of understanding of the invention, like reference numerals will be used for substantially identical components. FIG. 2 of the drawings illustrates the preferred embodiment of the invention in the form of a handheld security device or system 10A which incorporates therein the use of light sources of different wavelengths (or a single laser capable of multiple wavelengths. It should also be realized, however, that the present invention is not limited to handheld devices.

As shown in FIG. 2, the various components of this invention are contained within a rugged housing 12. All components are contained within housing 12, preferably made of aluminum, which is also preferably sealed and weatherproof. The function of the housing 12 is to provide protection to the internal components and to provide a rigid structure for all optical and electronic components. Within the housing 12 reside power source 14, preferably in the form of batteries (although a DC power supply can also be used), multiple lasers, each laser emitting light of a different color. For example, laser 24*a* is preferably red in color (Applied Optronics Corporation, AOC-670-250-T3), laser 24*b* is preferably green in color (Casix, DPGL-1050), and, if desired, a third laser 24*c* is preferably blue in color. It is also possible to use even additional lasers of different colors. Each laser is aligned into respective coiled optical fibers 18 (for example, Mitshubishi, SK-10 Optical Grade Fibers). A fiber coupling unit 22 (for example, Thor Labs, Inc., 10770A, SMA Connector) serves to bring the multiple coiled fibers 18 to a single output point. Any suitable optical lens assembly 20 (for, example, Lens 1 Optimax Corporation, Custom Spherical, Lens 2 Optimax Corporation, Custom Spherical, Lens 3 Newport Corporation, KPX-232) shapes the beam, provides uniform intensity distribution, and collimates the beam. The optical lens assembly 20 preferably has some adjustablility in order to obtain a desired spot size for the particular application. This adjustablility feature is described in U.S. patent application Ser. No. 08/967,426. The device 10A is activated using a momentary ON/OFF activation switch 26 located on the outside of housing 12 in a manner similar to that described in U.S. Pat. No. 5,685,636 and U.S. patent application Ser. No. 08/967,426 now U.S. Pat. No. 6,007,218. A multi-position switch 40 is used to select which laser or lasers will be activated in a manner as set forth in detail below.

Figure 7:
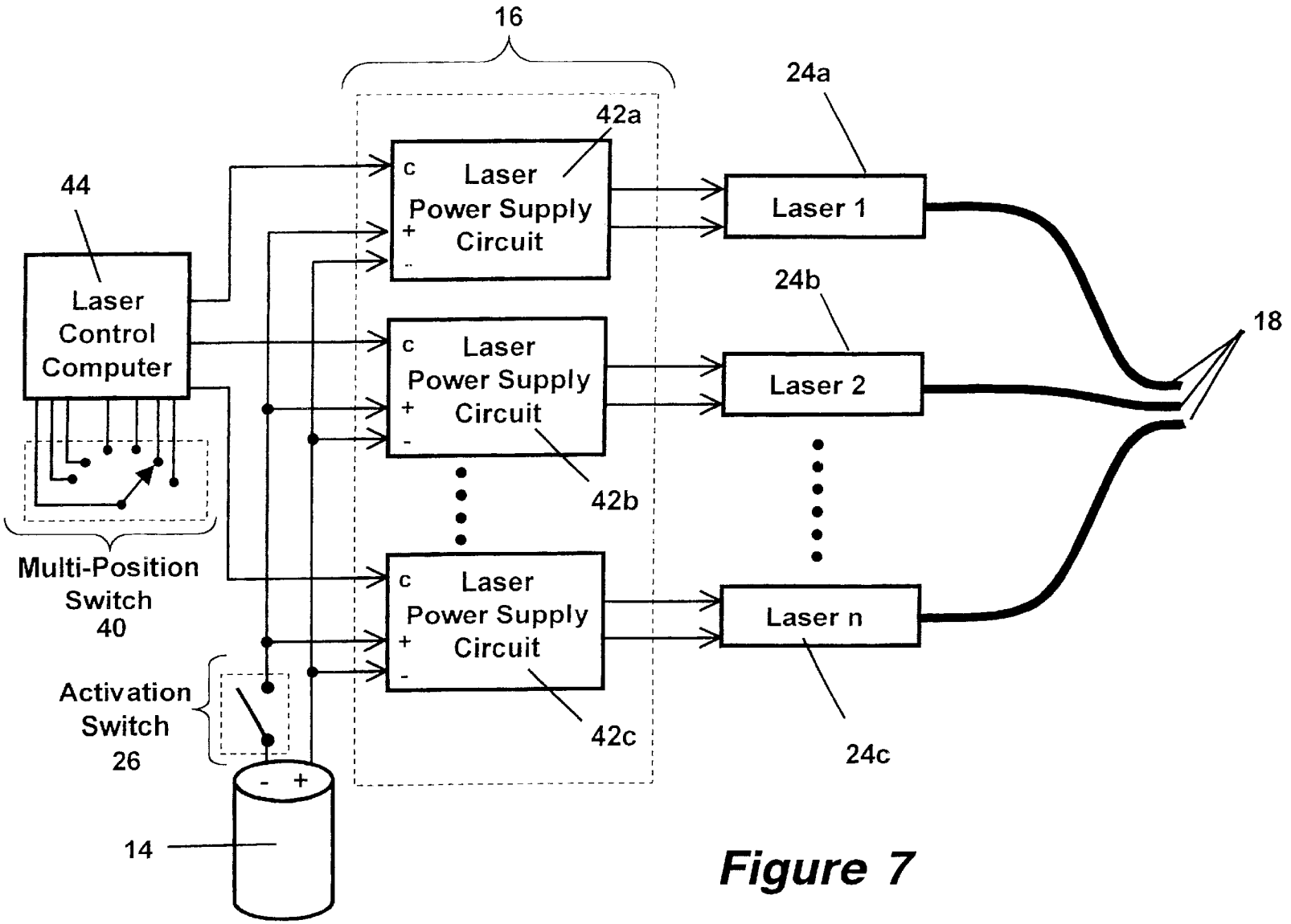
FIG. 7 is a schematic representation of the electronics and control circuitry used to power multiple lasers.
Figure 8:
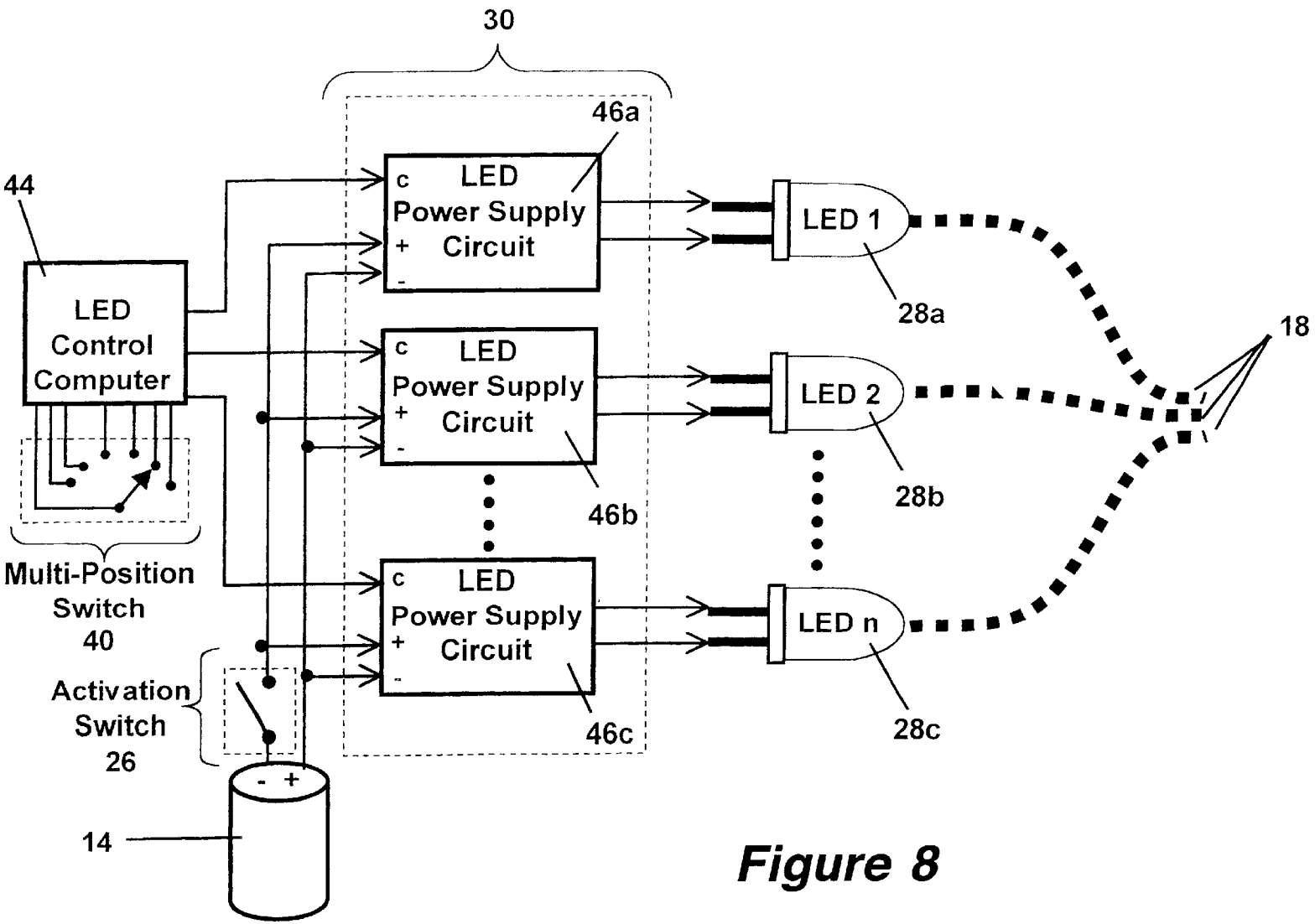
FIG. 8 is a schematic representation of the electronics used to drive multiple LEDs.

All of the embodiments of the present invention are capable of activating several modes using the multi-position switch 40 and the momentary ON/OFF switch 26 and the control computer 44 described in more detail with respect to FIGS. 7 and 8. One mode of operation would allow continuous ON mode for one or more of the selected light sources. For example, red green, or blue light sources would be emitted continuously from the device. Additionally, another mode of operation would allow for flickering (blinking) of one or more selected light emitting sources. For example, red, green or blue light sources flickering at the same time (in phase). Another mode would involve flickering selected light sources in an offset manner, perhaps completely out of phase from each other. For example, red and green light sources flickering at the same frequency such that the red source is ON while the green source is OFF, so that light emitted from the device alternates red, green, red, green, etc.. Also, another mode of operation would consist of flickering selected light sources at different frequencies. For example, a red source flickers 8 times per second, a green source flickers 12 times per second and a blue source at 16 times per second. Finally, any number of modes consisting of a combination of those just described. For example, a blue light emits continuously while red and green sources flicker (either at the same time, or offset, or at different frequencies).

In the present invention multi-position switch 40 is capable of activating the modes described above. For example, continuous ON mode for all lasers 24*a,* 24*b,* 24*c,* continuous ON mode for selected lasers, such as 24*a,* 24*b,* flicker (or blinking) mode for all lasers 24*a,* 24*b,* 24*c,* and flicker mode of only select color lasers 24*a,* 24*b,* 24*c* at various flicker frequencies. In addition, the flicker mode of operation could also be controlled with the momentary ON/OFF switch 26 by incorporating a delay or timer circuit. In this scenario, if the momentary ON/OFF switch 26 is activated, continuous light may be emitted from the beam for 5 seconds, then the device would automatically engage flicker or flashing mode. Depressing of the momentary ON/OFF activation switch 26 activates the device or system 10A once a setting has been selected with the multi-position switch 40. It would also be desirable to change the multi-position switch 40 while the main momentary ON/OFF switch 26 is engaged. With the present invention, a flash rate of approximately 8 Hz provides optimal disorientation for on-off flashing. If the light is flashed between two colors in different parts of the visible spectrum (red and green or red and blue for example) rather than on and off, the disorientation is enhanced because the eye is trying to adapt.

The electronics 16 used with the lasers are also preferably located inside the housing 12 and are described in detail in U.S. patent application Ser. No. 08/967,426 now U.S. Pat. No. 6,007,218 which is incorporated herein by reference. FIG. 7 and its associated description provided below also explains electronics 16. It is important that each laser 24*a,* 24*b,* and 24*c* be kept at a constant intensity output in order to ensure eye safe levels of exposure and proper operation/lifetime of the laser 24*a,* 24*b,* 24*c*. The electronics 16 are equipped with monitor-photodiode feedback circuits to keep the output intensity level of the lasers 24*a,* 24*b,* 24*c* constant.

Still referring to FIG. 2, each laser 24*a,* 24*b,* 24*c* has a respective coiled optical fiber 18 associated with it. The optical fibers 18 are aligned with their respective laser 24*a,* 24*b,* or 24*c* to provide good optical throughput. The fibers are coiled into multiple loops in order to "mix-up" or "homogenize" the output beam. Reference is made to U.S. patent application Ser. No. 08/967,426 for additional fiber coiling information. This coiling also keeps the intensity profile of the output beam to be very nearly constant throughout the beam area as shown in FIG. 1*b*. The output end of the coiled fibers 18 are assembled into a conventional coupling device 22 which is mounted near the focal point of the optical lens assembly 20.

Figure 3:
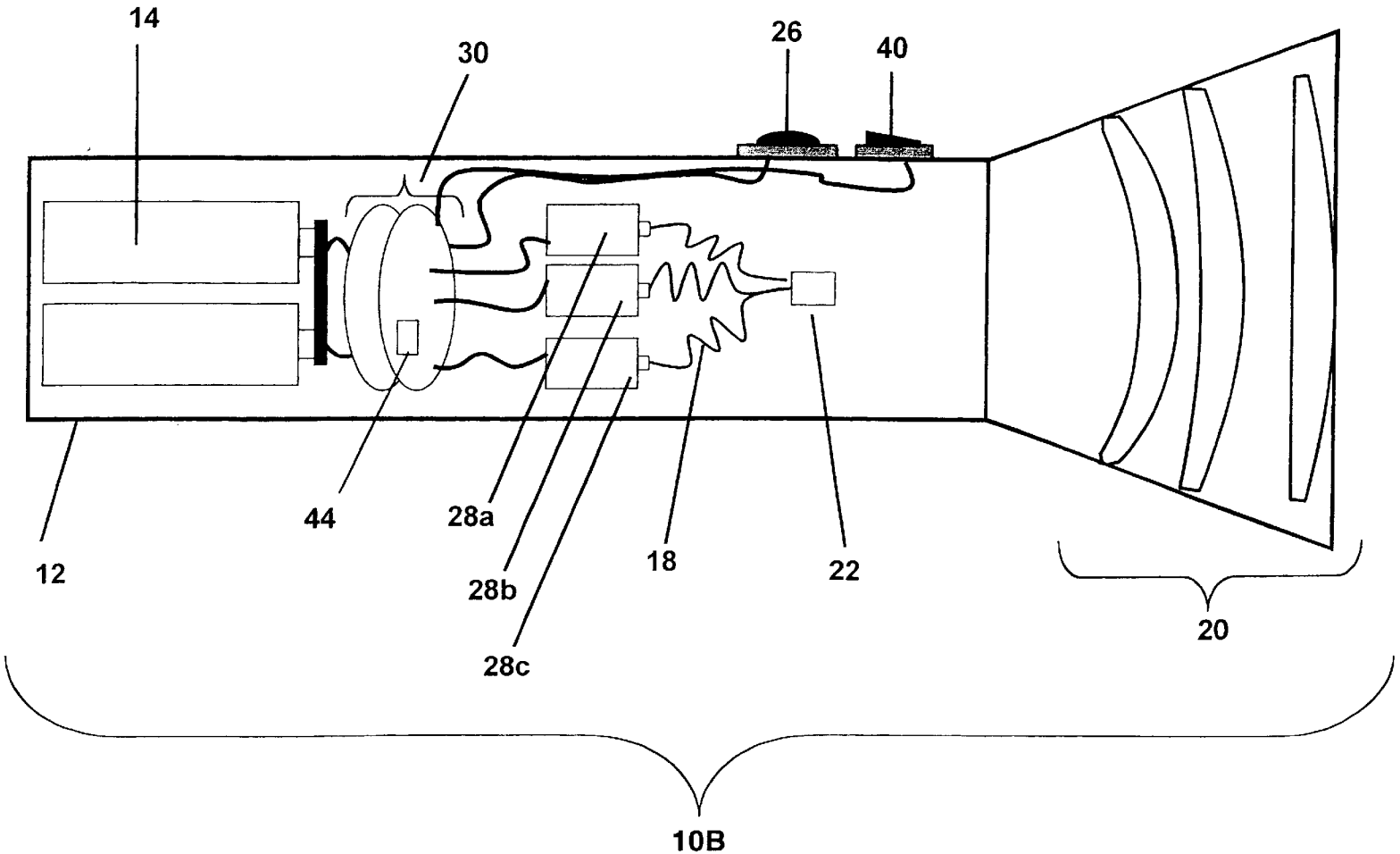
FIG. 3 is a schematic representation of another embodiment of the present invention using multiple light-emitting (LED) light sources.
Figure 5:
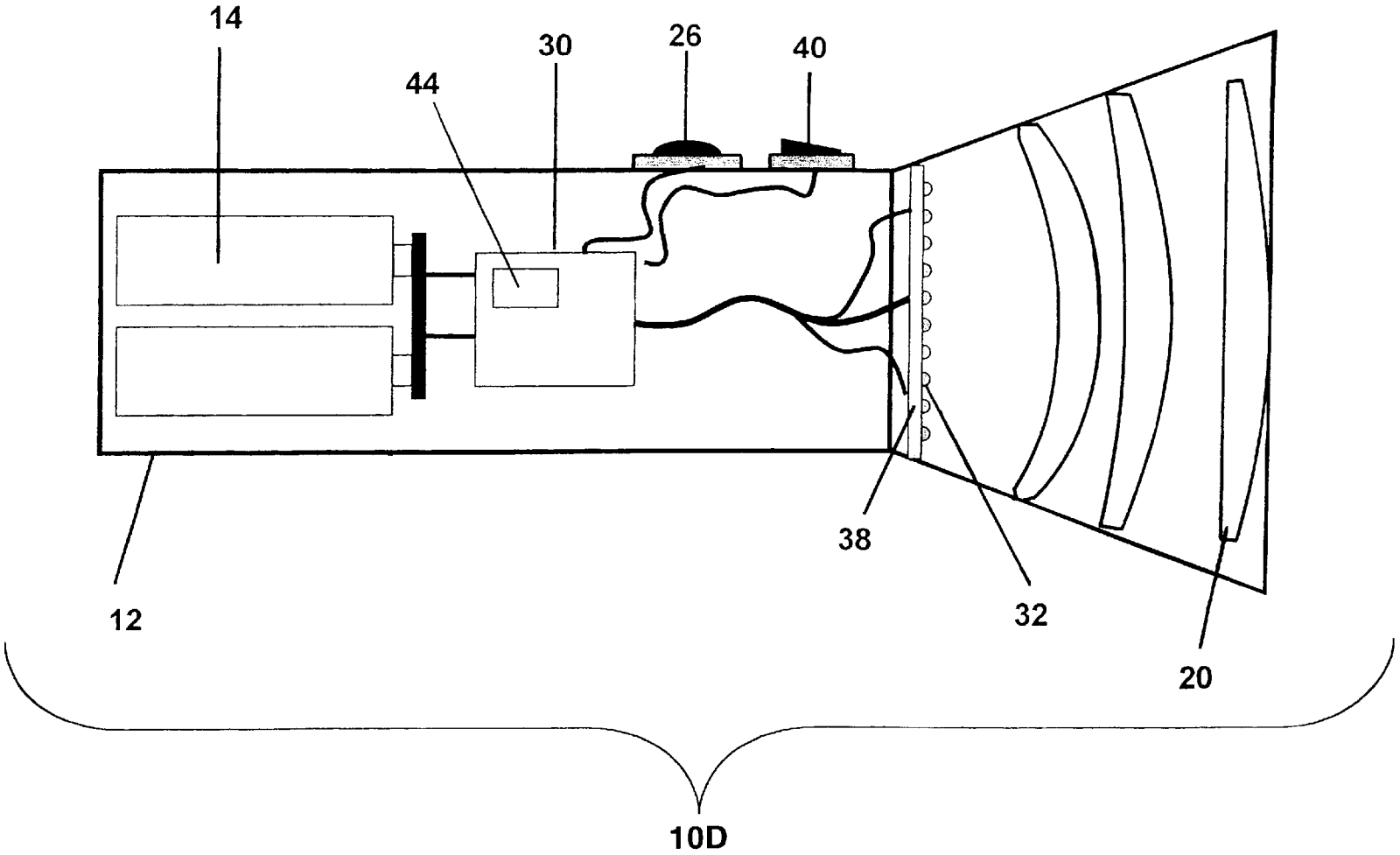
FIG. 5 is a schematic representation of a further embodiment of the present invention using an LED array.

FIG. 3 shows a variation of the preferred embodiment of FIG. 2 in which security device or system 10B uses multiple LEDs 28*a,* 28*b* and 28*c* in place of the multiple lasers 24*a,* 24*b* and 24*c,* respectively. Contained within housing 12 are multiple LEDs 28*a* (preferably red in color, OptoTechnology OTL-660a-3-4-66E or Gilway Technical Lamp, E184), 28*b* (preferably green in color, OptoTechnology OTL-530a-9-4-66E or Gilway Technical Lamp, E903), and 28*c* (preferably blue in color, OptoTechnology OTL-470-3-4-66E or Gilway Technical Lamp, E474). The LEDs 28*a,* 28*b,* and 28*c* may be fiber coupled using a coiled optical fiber 18 for each LED. Also, the LEDs could be arranged in an array 32 as shown in FIG. 5. Still referring to FIG. 3, the LEDs 28*a,* 28*b,* 28*c* are aligned with each coiled fiber 18, respectively. Coiling is necessary if beam shaping is needed. If the unmodified output of the LED is "round" or uniformly shaped, it may not be necessary to use a coiled fiber. However, if space inside a housing is limited, fibers may be used to "guide" the beam location where it may be imaged. Once coiled, the fibers 18 are polished. Polishing of fibers is commonly accomplished by sanding the fiber face with sequentially higher grit sandpaper until the desired finish is attained. Once polished, the fibers 18 are collected together in a conventional fiber coupling device 22. Any suitable optical lens assembly 20 is used to shape the beam for a variety of uses. A lens assembly that diverges the beam quickly may be useful for short-range applications, and a lens assembly that has a small divergence or is collimated is preferred for long range applications. Adjustment in the placement of the lens assembly 20 may be desirable in order to have additional options of spot size. A momentary ON/OFF switch 26 and multi-position switch 40 are used to activate the device or system 10B in a variety of modes as discussed above with respect to the embodiment of FIG. 2.

It is important to note that the electronics 30 (described in detail with respect to FIG. 8) used to drive the LEDs 28*a,* 28*b,* and 28*c* is very simplified from the circuitry used with the lasers. LEDs are easy to power with only batteries 14 and a simple voltage regulator integrated circuit and associated resistors and capacitors while the circuitry of electronics 16 requires sophisticated power supply circuitry. LEDs are cost effective and have a long, stable lifetime, therefore a monitor photodiode or other sophisticated electronics are not needed. Less sophisticated electronics along with low LED prices make this embodiment very cost effective for short range applications.

Figure 4:
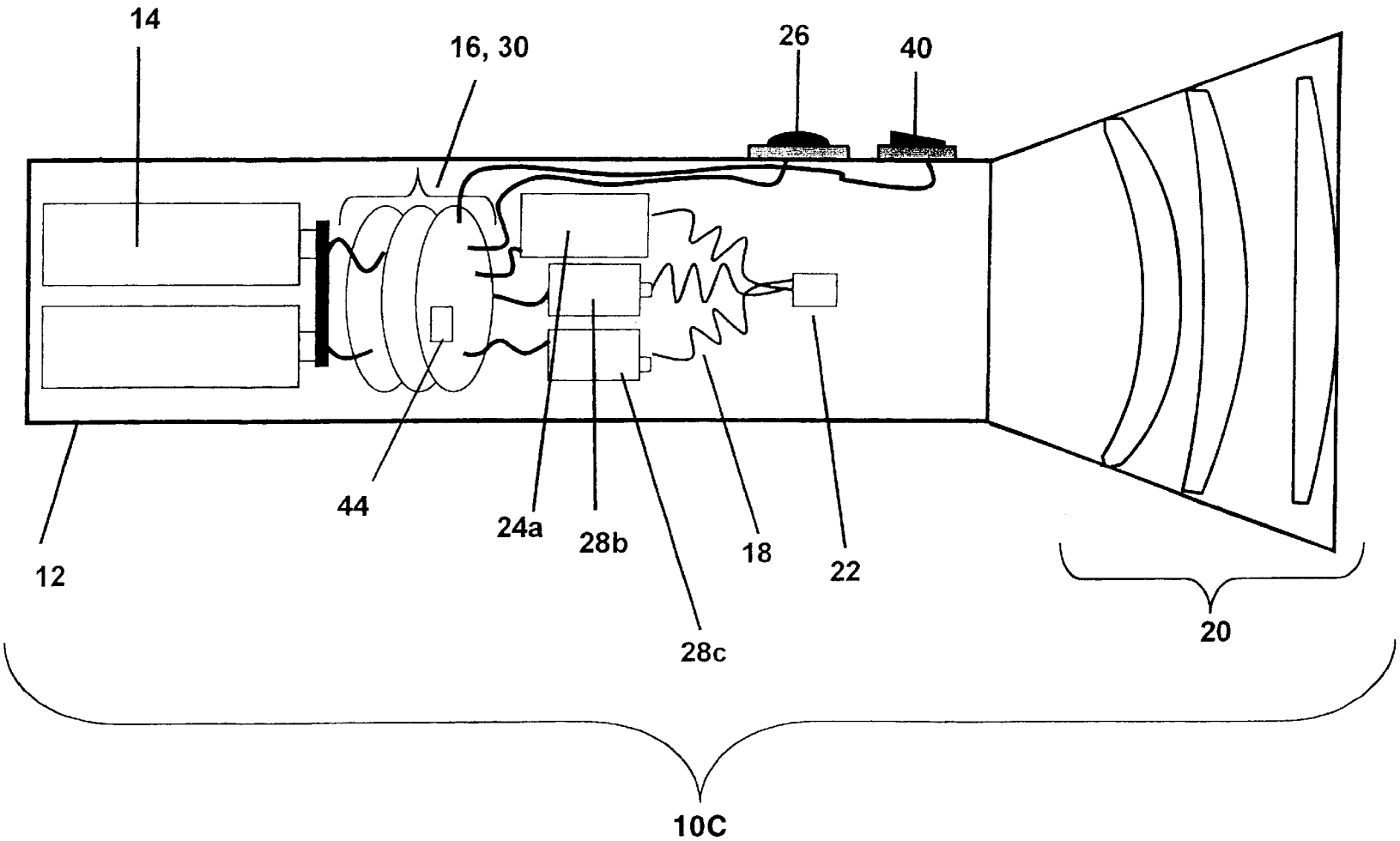
FIG. 4 is a schematic representation of still another embodiment of the present invention utilizing a hybrid laser/LED light source.

FIG. 4 depicts a hybrid version of the invention as embodied in device 10C in which both a laser 24*a* and LEDs 28*b,* 28*c* are used to provide an effective visual countermeasure, although the exact combination of lasers and LEDs may vary within the scope of this invention. This embodiment of the invention is desirable in order obtain a good mix of output power with cost effectiveness. Preferably laser 24*a* is red in color, small, compact, and commonly available. LEDs 28*b,* and 28*c* provide green and blue light, respectively. All of the light sources 24*a,* 28*b,* and 28*c* may be coupled with respective optical fibers 18 and brought together at a fiber coupling device 22. Once again, any suitable optical lens assembly 20 gives beam shaping capabilities to the output beam(s). The electronics 16 are moderately sophisticated, a portion of the electronics 16 must be able to provided constant current to the laser 24*a* (such as laser power supply circuit 42*a* as shown in FIG. 7). The LED electronics 30 needed to supply power to the light sources

18*b* and 28*c* require only simple voltage regulator integrated circuits (such as shown by the LED power supply circuits in FIG. 8) in order to operate within specification. The batteries 14 provide power to the device 10C. A momentary ON/OFF activation switch 26 activates the device 10C. The device 10C can be activated in several modes including both continuous and flicker of one or more light sources 24*a,* 28*b,* and 28*c* using the multi-position switch 40. This embodiment of the invention is very versatile and provides effective long and short range capability.

FIG. 5 of the drawings depicts another embodiment of the preferred embodiment. The light source in the device 10D of this embodiment is in the form of an array of LEDs 32 mounted to a base such as a printed circuit board (PCB) 38. This embodiment of the invention is simply powered by the batteries 14 and electronics module 30 of the type described with reference to FIG. 2 above and FIG. 8 below. Once again any suitable optical lens assembly 20 may be used to shape or focus the output beam. A momentary switch 26 provides activation to the system 10D in a variety of modes as described hereinabove.

Figure 6:
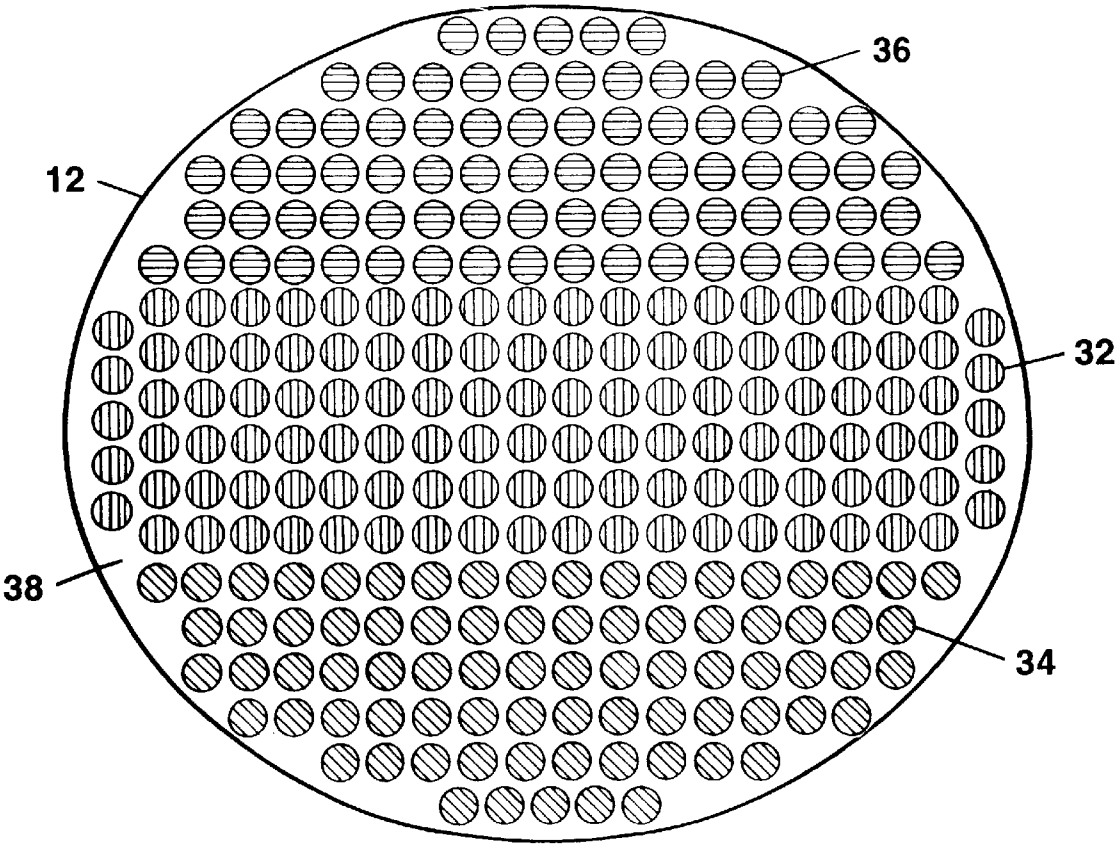
FIG. 6 is a front view of the LED array utilized in the embodiment of FIG. 5.

FIG. 6 illustrates a front view of the LED array 32 used in the above embodiment. An array 32 of multicolored LEDs (red), 34 (green), 36 (blue) are mounted on the base 38. This array 32 is then mounted into the housing 12. An optical lens assembly (not shown in this figure) may be needed to shape the outcoming beam.

Reference is now made more specifically to the electronics 16 and 30 utilized within the various embodiments of this invention. FIG. 7 is a schematic of the electronic circuitry 16 that provides for sequentially flashing multiple lasers. Each laser 24*a,* 24*b* and 24*c* is powered by a separate laser power supply circuit 42*a,* 42*b* and 42*c,* respectively. Each of the power supply circuits 42*a,* 42*b* and 42*c* is preferably identical in design to the Laser Diode Switching Power Supply Circuit in U.S. Pat. No. 5,685,636 and U.S. patent application Ser. No. 08/518,230, both of which being incorporated herein by reference. The power supply circuits 42*a,* 42*b,* and 42*c* provide the well-regulated, constant-current electrical power required for safe operation of semiconductor laser diodes. A laser control computer 44 utilizing, for example, an inexpensive Programmable Integrated Circuit (PIC) (Microchip Technology, Inc., PIC12CE67X), provides individual ON/OFF control signals to the control input pins of the multiple power supply circuits 42*a,* 42*b,* and 42*c*. The PIC contained within the laser control computer 44 is programmed to provide the appropriate ON/OFF control signals in response to a multi-position switch 40, which is set by the user to select operating modes. Battery power 14 provides DC electrical power to the laser power supply circuits 42*a,* 42*b,* and 42*c* and the laser control computer 44 whenever the momentary ON/OFF activation switch 26 is depressed by the user to activate the security device 10A.

FIG. 8 is a schematic of the electronic circuitry 30 that provides for sequentially flashing multiple LEDs. The operation of the LED control circuit 30 is basically identical to that described for the multiple laser control circuit 16 shown in FIG. 7. As with circuitry 16, a PIC based control computer 44 is programmed to provide the appropriate ON/OFF control signals in response to a multi-position switch 40 whenever the momentary ON/OFF activation switch 26 is depressed. However, it is important to note that the LED power supply circuits 46*a,* 46*b,* and 46*c* differ from the laser power supply circuit 42*a,* 42*b,* and 42*c* of FIG. 7. The lasers (24*a,* 24*b,* and 24*c* shown in FIG. 7) require a complex switching power supply to provide a constant current. The LEDs, however, require only simple voltage regulator integrated circuits 46*a,* 46*b,* and 46*c* (Micrel Semiconductor, MIC2951), respectively. Such voltage regulator integrated circuits are very inexpensive, usually costing substantially less than the laser power supply circuits 42*a,* 42*b,* and 42*c*. The power supply cost difference, when combined with the very large cost difference between laser diodes and LEDs, provides embodiments of the present invention which are economically attractive.

Figure 9:
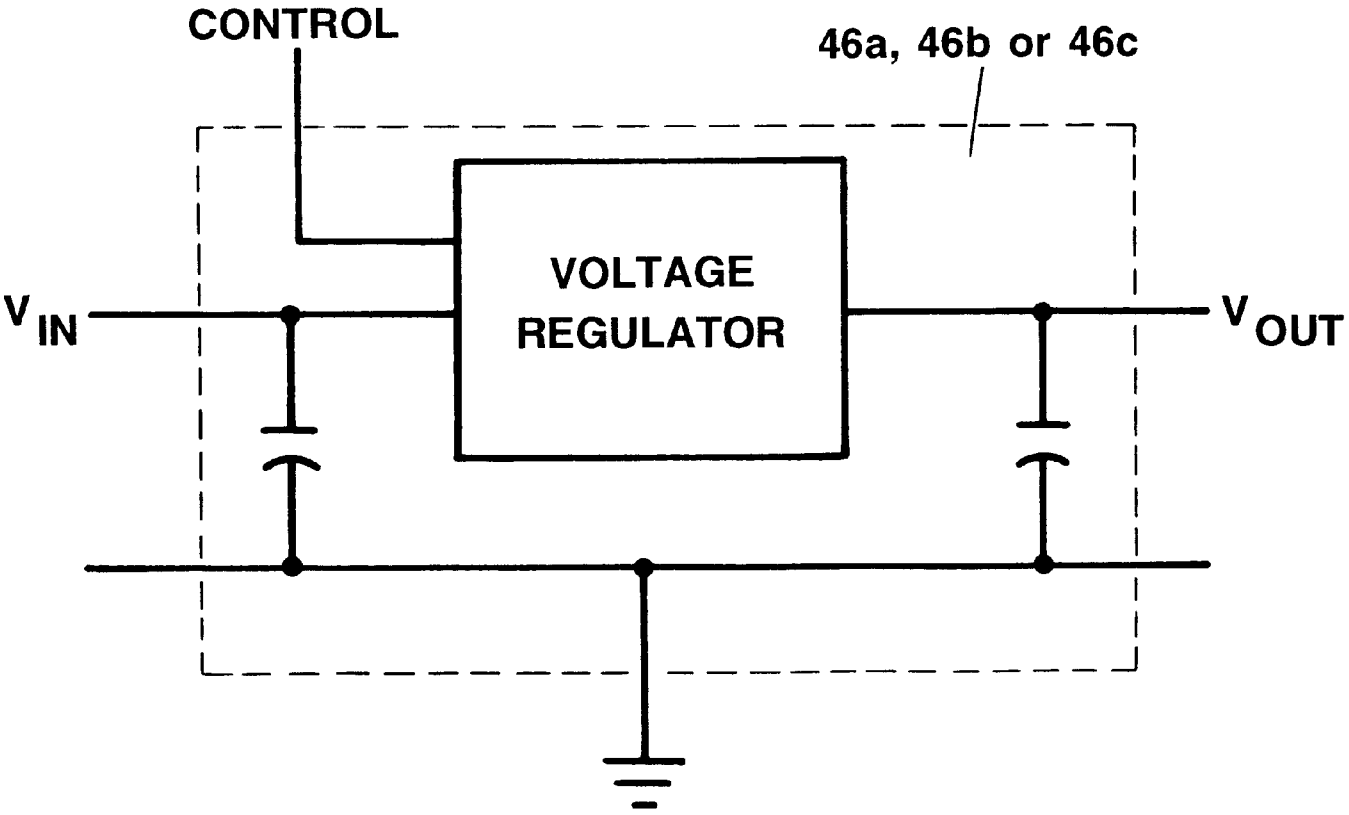
FIG. 9 is a schematic representation of the LED power supply circuit.

FIG. 9 is a schematic of the LED power supply circuit 46*a,* 46*b,* or 46*c* that provides operation of the LEDs. A simple commercial-off-the-shelf (COTS) voltage regulator circuit provides the electronics with a voltage in, voltage out, control signal, and common ground. This circuit is highly simplified from the laser power supply circuit (42*a,* 42*b* or 42*c*) and the laser power supply circuitry depicted in U.S. patent application Ser. No. 08/518,230.

Although the invention has been described with respect to various embodiments, it should be realized this invention is also capable of a wide variety of further and other embodiments within the spirit and scope of the appended claims.

What is claimed is:

1. A non-lethal visual security device comprising:

at least two light emitting sources, each of said light emitting sources providing a beam of light of a different color, and at least one of said at least two light emitting sources being a laser light source;

each said beam of light being in the form of a substantially uniform beam of light having an intensity which falls below a preselected intensity level;

means for monitoring and maintaining said intensity below said preselected intensity level; and a switching system operably interconnected to said at least two light emitting sources, said switching system effecting a predetermined number of modes of operation for said light emitting sources in order to provide a variety of light patterns being output from said security device;

wherein said security device is capable of effective operation as a non-lethal means for controlling the actions of an adversary.

2. The non-lethal visual security device as defined in claim 1 wherein said switching system comprises a power source connected to at least one laser power supply circuit, a laser control computer connected to said at least one laser power supply circuit, a multi-position switch connected to said laser control computer, and an activation switch connected between said power supply and said at least one laser power supply circuit; said multi-position switch and said activation switch operating in conjunction with one another in order to provide said predetermined number of modes of operation.

3. The non-lethal visual security device as defined in claim 1 wherein said predetermined number of modes of operation for said light emitting sources includes any one of or a combination of at least the following modes: a continuous "on" mode for all light emitting sources, a continuous "on" mode for preselected light emitting sources.

4. The non-lethal visual security device as defined in claim 3 wherein said following modes further include: a flicker (blinking) mode for all light emitting sources, a flicker (blinking) mode for preselected light emitting sources.

5. The non-lethal visual security device as defined in claim 4 wherein said flicker mode is in phase for preselected light emitting sources.

6. The non-lethal visual security device as defined in claim 3 wherein said switching system comprises a power source connected to at least one power supply circuit, a control computer connected to said at least one power supply circuit, a multi-position switch connected to said control computer, and an activation switch connected between said power supply and said at least one power supply circuit.

7. The non-lethal visual security device as defined in claim 1 wherein said security device is a hand-held device.

8. The non-lethal visual security device as defined in claim 1 wherein said power source is at least one battery.

9. The non-lethal visual security device as defined in claim 1 further comprising a lens assembly and at least two optical fibers for directing each of said beam of light, respectively, from each of said light emitting sources to a preselected location for imaging through said lens assembly.

10. The non-lethal visual security device as defined in claim 9 further comprising means for coupling output ends of said optical fibers to image each of said light beams at said preselected location.

11. The non-lethal visual security device as defined in claim 3 wherein at least one of said at least two light emitting sources is a laser light source.

12. The non-lethal visual security device as defined in claim 3 wherein at least one of said at least two light emitting sources is a non-laser light source.

13. The non-lethal visual security device as defined in claim 3 wherein said beam of light produced by one of said light emitting sources is red and said beam of light produced by another one of said light emitting sources is green.

14. A non-lethal visual security device comprising:

at least two light emitting sources, each of said light emitting sources providing a beam of light of a different color;

each said beam of light being in the form of a substantially uniform beam of light having an intensity which falls below a preselected intensity level; and a switching system operably interconnected to said at least two light emitting sources, said switching system effecting a predetermined number of modes of operation for said light emitting sources in order to provide a variety of light patterns being output from said security device; and said switching system comprising a power source connected to at least one power supply circuit, a control computer connected to said at least one power supply circuit, a multi-position switch connected to said control computer, and an activation switch connected between said power supply and said at least one power supply circuit, said multi-position switch and said activation switch operating in conjunction with one another in order to provide said predetermined number of modes of operation;

wherein said security device is capable of effective operation as a non-lethal means for controlling the actions of an adversary.

15. The non-lethal visual security device as defined in claim 14 wherein at least one of said at least two light emitting sources is a non-laser light source.

16. The non-lethal visual security device as defined in claim 14 wherein said beam of light produced by one of said light emitting sources is red and said beam of light produced by another one of said light emitting sources is green.

17. The non-lethal visual security device as defined in claim 16 further comprising at least three light emitting sources and wherein said beam of light produced by still another of said light emitting sources is blue.

18. The non-lethal visual security device as defined in claim 15 wherein said at least one of said at least two non-laser light emitting sources is a light emitting diode (LED).

19. The non-lethal visual security device as defined in claim 14 wherein said beam of light produced by one of said light emitting sources is red and said beam of light produced by another one of said light emitting sources is blue.

20. The non-lethal visual security device as defined in claim 14 wherein said beam of light produced by one of said light emitting sources is blue and said beam of light produced by another one of said light emitting sources is green.

21. The non-lethal visual security device as defined in claim 14 wherein said security device is a hand-held device.

22. The non-lethal visual security device as defined in claim 14 wherein said power source is at least one battery.

23. The non-lethal visual security device as defined in claim 14 further comprising a lens assembly and at least two optical fibers for directing each of said beam of light, respectively, from each of said light emitting sources to a preselected location for imaging through said lens assembly.

24. A non-lethal visual security device comprising:

at least two light emitting sources, each of said light emitting sources providing a beam of light of a different color;

each said beam of light being in the form of a substantially uniform beam of light having an intensity which falls below a preselected intensity level;

a switching system operably interconnected to said at least two light emitting sources, said switching system effecting a predetermined number of modes of operation for said light emitting sources in order to provide a preselected output from said security device;

said predetermined number of modes of operation for said light emitting sources includes any one of or a combination of at least the following modes: a continuous "on" mode for all light emitting sources, a continuous "on" mode for preselected light emitting sources, a flicker (blinking) mode for all light emitting sources, a flicker (blinking) mode for all light emitting sources; and said flicker mode is out of phase for preselected light emitting sources;

wherein said security device is capable of effective operation as a non-lethal means for controlling the actions of an adversary.

25. A non-lethal visual security device comprising:

at least two light emitting sources, each of said light emitting sources providing a beam of light of a different color;

each said beam of light being in the form of a substantially uniform beam of light having an intensity which falls below a preselected intensity level;

a switching system operably interconnected to said at least two light emitting sources, said switching system effecting a predetermined number of modes of operation for said light emitting sources in order to provide a preselected output from said security device;

said predetermined number of modes of operation for said light emitting sources includes any one of or a combination of at least the following modes: a continuous "on" mode for all light emitting sources, a continuous "on" mode for preselected light emitting sources, a flicker (blinking) mode for all light emitting sources, a flicker (blinking) mode for all light emitting sources; and said flicker mode is at different frequencies for preselected light emitting sources;

wherein said security device is capable of effective operation as a non-lethal means for controlling the actions of an adversary.

26. A non-lethal visual security device comprising:

at least two light emitting sources, each of said light emitting sources providing a beam of light of a different color;

each said beam of light being in the form of a substantially uniform beam of light having an intensity which falls below a preselected intensity level;

a switching system operably interconnected to said at least two light emitting sources, said switching system effecting a predetermined number of modes of operation for said light emitting sources in order to provide a preselected output from said security device; and a lens assembly and at least two optical fibers for directing each of said beam of light, respectively, from each of said light emitting sources to a preselected location for imaging through said lens assembly, with at least one of said optical fibers being coiled;

wherein said security device is capable of effective operation as a non-lethal means for controlling the actions of an adversary.

27. The non-lethal visual security device as defined in claim 26 further comprising at least three light emitting sources and wherein said beam of light produced by still another of said light emitting sources is blue.

28. A method of employing a non-lethal visual security device in adversarial conditions comprising the steps of:

providing a non-lethal visual security device having at least two light emitting sources, each of said light emitting sources providing a beam of light of a different color;

producing each said beam of light in the form of a substantially uniform beam of light having an intensity which falls below a preselected intensity level;

aiming said security device at an adversary; and operating the device in a predetermined mode of a plurality of predetermined modes of operation in order to provide a variety of light patterns being output from said security device;

whereby said security device is capable of effective operation as a non-lethal means for controlling the actions of an adversary.

29. The method of employing a non-lethal visual security device as defined in claim 28 further comprising the step of:

regulating the operation of the device by selectively using any one of or a combination of any of the following modes: continuous "on" mode for all light emitting sources, continuous "on" mode for preselected light emitting sources.

30. The method of employing a non-lethal visual security device as defined in claim 29 wherein said following modes further include: a flicker (blinking) mode for all light emitting sources, a flicker (blinking) mode for preselected light emitting sources.

31. The method of employing a non-lethal visual security device as defined in claim 30 wherein said flicker mode is in phase for preselected light emitting sources.

32. The method of employing a non-lethal visual security device as defined in claim 31 wherein said flicker mode is out of phase for preselected light emitting sources.

33. The method of employing a non-lethal visual security device as defined in claim 32 wherein said flicker mode is at different frequencies for preselected light emitting sources.

* * * * *